US009617121B2

(12) United States Patent
Bolme et al.

(10) Patent No.: US 9,617,121 B2
(45) Date of Patent: Apr. 11, 2017

(54) INSTALLATION METHOD FOR AN ELEVATOR

(71) Applicant: Inventio AG, Hergiswill (CH)

(72) Inventors: Ole Bolme, Meggen (CH); Harald Schwark, Buchrain (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 14/653,959

(22) PCT Filed: Dec. 3, 2013

(86) PCT No.: PCT/EP2013/075386
§ 371 (c)(1),
(2) Date: Jun. 19, 2015

(87) PCT Pub. No.: WO2014/095348
PCT Pub. Date: Jun. 26, 2014

(65) Prior Publication Data

US 2015/0314993 A1 Nov. 5, 2015

(30) Foreign Application Priority Data

Dec. 19, 2012 (EP) ..... 12198106

(51) Int. Cl.
*B66B 19/00* (2006.01)

(52) U.S. Cl.
CPC ..... *B66B 19/002* (2013.01); *B66B 19/00* (2013.01)

(58) Field of Classification Search
CPC ..... B66B 19/00; B66B 19/002; B66B 5/0087
USPC ..... 187/414
See application file for complete search history.

(56) References Cited

U.S. PATENT DOCUMENTS 3,763,964 A * 10/1973 Davis ..... B66B 9/187 187/239
3,851,736 A * 12/1974 Westlake ..... B66B 19/002 29/429
4,345,671 A * 8/1982 Tosato ..... B66B 19/002 29/429
5,000,292 A 3/1991 Chapelain et al.
5,005,672 A * 4/1991 Nakai ..... H02K 41/025 187/250
5,065,843 A * 11/1991 Richards ..... B66B 19/002 187/408
5,230,404 A * 7/1993 Klein ..... B66B 19/00 187/414
6,357,556 B1 * 3/2002 Pettersson ..... B66B 5/04 187/414

(Continued)

FOREIGN PATENT DOCUMENTS

CN 1990371 A 7/2007
JP H08245116 A 9/1996
WO 2011048275 A 4/2011

*Primary Examiner* — Michael Riegelman
(74) *Attorney, Agent, or Firm* — Fraser Clemens Martin & Miller LLC; William J. Clemens

(57) ABSTRACT

An installation method for an elevator includes the following steps: provision of a counterweight frame to be moved along counterweight guide rails, provision of an installation platform to be moved along car guide rails, and loading of the counterweight frame with at least one elevator component and movement of the counterweight frame to the position of the installation platform.

11 Claims, 3 Drawing Sheets

(56) References Cited

U.S. PATENT DOCUMENTS

| | | | | |
|---|---|---|---|---|
| 6,422,352 | B1 * | 7/2002 | Pettersson | B66B 19/002 187/408 |
| 7,635,049 | B2 * | 12/2009 | Van Der Meijden | B66B 19/002 187/401 |
| 8,720,032 | B2 * | 5/2014 | Van der Meijden | B66B 19/02 187/414 |
| 2003/0136611 | A1 * | 7/2003 | Erny | B66B 19/00 187/401 |
| 2005/0275161 | A1 * | 12/2005 | Fischer | B66B 19/005 271/277 |
| 2009/0223751 | A1 * | 9/2009 | Peacock | B66B 19/00 187/414 |
| 2010/0133048 | A1 | 6/2010 | Barneman | |
| 2013/0233655 | A1 * | 9/2013 | Peacock | B66B 19/00 187/414 |
| 2013/0284543 | A1 * | 10/2013 | De Jong | B66B 11/00 187/249 |
| 2014/0000987 | A1 * | 1/2014 | Peacock | B66B 19/00 187/414 |
| 2015/0314993 | A1 * | 11/2015 | Bolme | B66B 19/002 52/741.1 |

* cited by examiner

INSTALLATION METHOD FOR AN ELEVATOR

FIELD

The invention relates to an installation method for an elevator, particularly for the installation of elevators in high buildings.

BACKGROUND

In an installation method of an elevator it is desirable, inter alia, to optimize the sequence with respect to expenditure of time as well as to safety. Particularly in the installation of an elevator in a high building, the high constructional height or head imposes special demands with respect to efficiency in terms of time and to safety in an installation method. By a building of a high constructional height there is to be understood a building from approximately 30 floors and higher.

US 2010/0133048 A1 shows an installation method for an elevator in which an installation platform is used. The installation platform is connected with a hoist temporarily mounted in the shaft. This hoist consists substantially of a cable which is fastened in the upper region of the shaft and a drive which can move along the cable. In that case, the drive is in operative contact with the cable by a drive pulley. The pressure of the cable on the drive pulley is such that in the case of rotational movement of the drive pulley the drive correspondingly moves along the cable. The installation platform is connected with the drive and moves together with the drive.

According to US 2010/0133048 A1 the installation platform is positioned at the start of the installation method in the vicinity of the shaft pit. Elevator components are constantly brought to the installation platform from where these are mounted in the shaft area. In that case, the installation method provides that the installation platform is moved upwardly into different mounting positions by means of the drive at the cable until the installation platform reaches an uppermost or last mounting position. At the conclusion of the installation method the installation platform itself serves at least as a sub-structure of the elevator car.

This installation method is thus distinguished not only by an efficient procedure, but also by optimum utilization of the structures already present during the installation. In addition, the mounting work from an installation platform moving in the shaft is very safe. In that case, a balustrade reliably safeguards the workers from falling into the shaft pit.

SUMMARY

An object of the present invention is to further improve the installation method for an elevator, particularly for elevators in high buildings.

The set object is fulfilled by an installation method with the following steps:

- providing a counterweight frame (41) designed for the purpose of being moved along counterweight guide rails (21),
- providing an installation platform (51) designed for the purpose of being moved along car guide rails (33),
- loading the counterweight frame (41) with at least one elevator component and
- moving the counterweight frame (41) relative to the installation platform (51).

By this installation method, particularly the use of a counterweight frame as a material shuttle, elevator components can be moved simply and efficiently into the vicinity of a mounting position. Such elevator components can be represented by, for example, counterweight guide rails, car guide rails, shaft doors or a component of shaft doors, fastening means, traction means, drive parts, etc.

A further advantage of the installation method is that the counterweight frame can move independently of work platforms constructed to be movable or even stationary. A high level of conveying capacity of elevator components into the vicinity of a mounting position is thus ensured.

Further steps of the installation method relate to suspension of a hoist, comprising a support means and a drive, in the upper area of a travel region provided for the elevator, the mounting of at least one first set of counterweight guide rails at the structure bounding the travel region, particularly a shaft wall, the mounting of a counterweight frame guided at the at least first set of counterweight guide rails, the loading of the counterweight frame with at least one elevator component, particularly a second set of counterweight guide rails, the suspension of the counterweight frame at the hoist, the movement of the counterweight frame by means of the hoist into an unloading position, the unloading of the at least one elevator component from the counterweight frame and the mounting of the at least one elevator component on the structure bounding the travel region.

The support means used in the hoist are preferably formed as cables, particularly steel cables. Other forms of cable such as, for example, encased synthetic fiber cables, natural fiber cables or other forms of support means such as belts, chains or the like can obviously also be used.

In that case, the drive is preferably arranged at the support means to be automotive. In order to move forward at the support means the drive is in operative contact with the support means by way of a drive pulley. The drive moves along the support means in vertical direction upwardly or downwardly in correspondence with a rotational movement of the drive pulley. Thus, the elevator components loaded into the counterweight frame can be moved by means of the drive into the unloading position intended for later mounting. In that case the counterweight frame is connected with the drive by means of a connecting element, for example a cable or a chain.

The travel region of the elevator is typically present in a shaft. In that regard, the bounding structure of the travel region is delimited by four shaft walls, a shaft ceiling and a shaft pit. In departure therefrom the travel region can also be bounded by a free-standing framework structure or by a building outer wall such as is often the case with, for example, panoramic elevators.

A further step of the installation method relates to fixing of the counterweight frame after reaching the unloading position in the end region of the at least one set of counterweight guide rails. The counterweight frame is thus secured in its unloading position. An unintended movement of the counterweight frame during unloading of an elevator component is thus prevented.

The counterweight frame can preferably be connected with an end member arranged in the end region of the at least first set of counterweight guide rails. For example, a crossbeam, which is fastened on the set of counterweight guide rails, can serve as end member. The counterweight frame can be fastened to such a crossbeam by means of a suitable connection. For example, a screw connection, a hook connection, a clamping connection, a cable connection or the like is suitable for that purpose.

Alternatively, the counterweight frame can also be fixed in the unloading position by means of a holding brake acting on at least one counterweight guide rail.

Further steps of the installation method relate to suspension of the hoist from the counterweight frame at an elevator component, particularly a counterweight guide rail of the second set of counterweight guide rails, in the unloading position and lifting the elevator component or the counterweight guide rail into the region of the mounting position. Thanks to fixing of the counterweight frame in the unloading position the hoist can be released from the counterweight frame without this crashing down in uncontrolled manner. Thus, even heavy elevator components can be brought simply and conveniently to a mounting position.

A further step of the installation method relates to provision of a third set of counterweight guide rails in the lower travel area for later mounting on the structure bounding the travel region. The third set of counterweight guide rails is preferably mounted in alignment above the first set of counterweight guide rails.

Further steps of the installation method relate to mounting of at least one first set of car guide rails on the structure, provision of a second set of car guide rails in the lower travel area for later mounting on the structure and loading the counterweight frame with a third set of car guide rails for later mounting on the structure.

The steps according to the two latter sections have the advantage that the third set of counterweight guide rails as well as the first and second sets of car guide rails are provided for mounting already before possible later installation of an installation platform in the lower travel area, since the installation platform in the lowermost position thereof blocks an opening to the lower travel region or the shaft pit and substantially hampers introduction of further counterweight guide rails or car guide rails.

Further steps of the installation method relate to suspension of a further hoist, comprising a support means and a drive, in the upper area of the travel region, the mounting of an installation platform guided at the at least first set of car guide rails, the connection of the further hoist with the installation platform and the movement of the installation platform by means of the further hoist into a work position.

The second set of car guide rails provided in the lower travel area is preferably mounted in alignment above the first set of car guide rails.

Further steps of the installation method relate to suspension of the hoist at a car guide rail of the third set of car guide rails in the unloading position and lifting the car guide rail of the third set of car guide rails into the vicinity of a mounting position. The mounting position of the third set of car guide rails preferably lies in alignment with and above the second set of car guide rails.

Further steps of the installation method relate to automatic movement of the counterweight frame by means of the hoist into an upper or lower end position at the at least one set of counterweight guide rails as far as a corresponding upper or lower limit switch, actuation of the corresponding upper or lower limit switch by the counterweight frame on reaching the upper or lower end position and switching off the hoist when the corresponding upper or lower limit switch is actuated.

Through the mounting of limit switches firstly there is ensured reliable stopping of the counterweight frame at the end of a current travel range in correspondence with the progress in mounting of the counterweight guide rails or the car guide rails and secondly the counterweight frame can be automatically moved between a lower loading position and an upper unloading position without the attention of an engineer having to be directed to safe movement of the counterweight frame. During the travel time of the counterweight frame an engineer can therefore devote his or her entire attention to the mounting of elevator components.

A limit switch can be designed as an electromechanical switch which is actuated by movement of the counterweight frame into the upper or lower end position and switches off the drive. Obviously, the limit switch can also comprise a Hall sensor which detects a magnet, for example a permanent magnet, arranged at the counterweight frame and on detection of the magnet interrupts electrical power supply to the drive.

DESCRIPTION OF THE DRAWINGS

The installation method is further explained on the basis of further embodiments and drawings, in which.

DETAILED DESCRIPTION

An installation method for an elevator is illustrated by way of FIGS. 1 to 5. In this example, an elevator is installed in a shaft 1 of a building. The building has several floors 2.1, 2.2, **2.*n***, which are to be accessed by the elevator.

Figure 1:
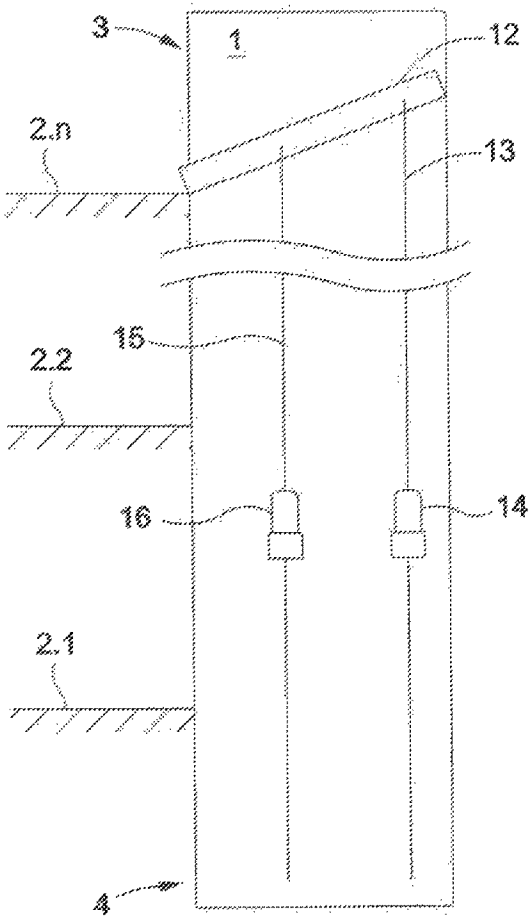
FIG. 1 shows an elevator shaft with two hoists.

In a first step, a girder 12 is mounted at the level of the uppermost floor **2.*n* in the upper area 3 of the shaft 1. As can be seen in the view of FIG. 1, the girder 12 is mounted to protrude into the shaft 1 at an inclination. In that case a first end, here the left-hand end, of the girder 12 is pivotably mounted on the floor of the uppermost building floor 2.*n* and a second end remote therefrom, here the right-hand end, is leaned against a side wall of the shaft 1**.

The girder 12 has two suspension points each for a respective hoist. These suspension points can be designed as, for example, eyes. The hoist comprises at least one support means or device 13, 15 such as, for example, a cable, and a drive 14, 16 which is automotively movable along the support means 13, 15. The support means 13, 15 can be simply suspended by a hook at a suspension point at the support 12. The suspension points are so arranged at the support 12 that a first hoist 13, 14 hangs in the travel region of a counterweight installed later and a second hoist 15, 16 hangs in the travel region of an elevator car installed later.

Figure 2:
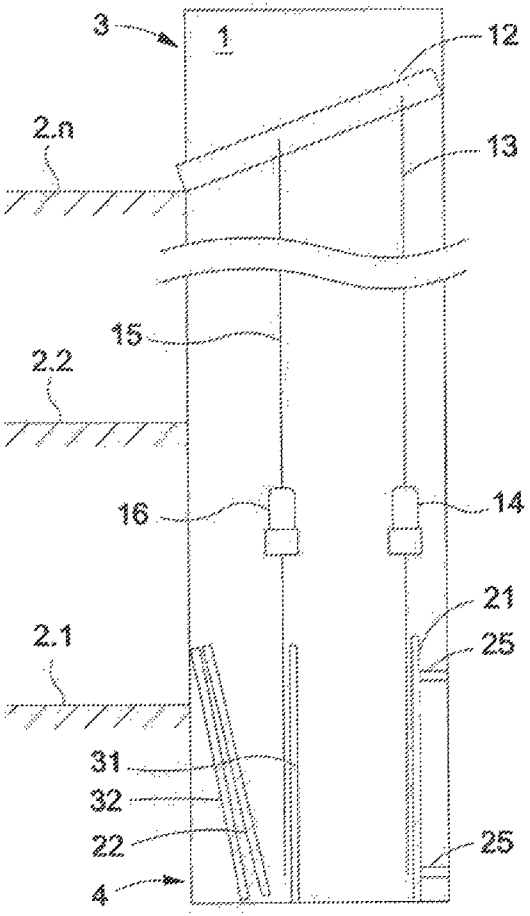
FIG. 2 shows the elevator shaft of FIG. 1 with a first mounted set of counterweight and car guide rails and a provided second set of counterweight and car guide rails.

In a next step, a first set of counterweight guide rails 21 and car guide rails 31 is mounted in a lower area 4 of the shaft 1. The mounting of these guide rails 21, 31 at side walls of the shaft 1 is carried out by way of brackets 25. For reasons of clarity only the brackets 25 for the counterweight guide rails are illustrated in FIG. 2. For the sake of simplicity, a set of counterweight guide rails 21 and a set of a car guide rails 31 are each illustrated in FIG. 2 only by one guide rail. However, guide rail pairs 21, 31 are usually provided for guidance of movable elevator bodies such as, for example, an elevator car or a counterweight.

A further step is similarly illustrated in FIG. 2, namely the provision of a further set of counterweight and car guide rails 22, 32 later mounted in vertical alignment with the first set of guide rails 21, 31 in the shaft space. This has the advantage that at this point in time the further set of guide rails 22, 32 can be brought in particularly simple manner by way of a shaft opening on the lowermost floor 2.1 into the lower area 4 of the shaft 1.

Figure 3:
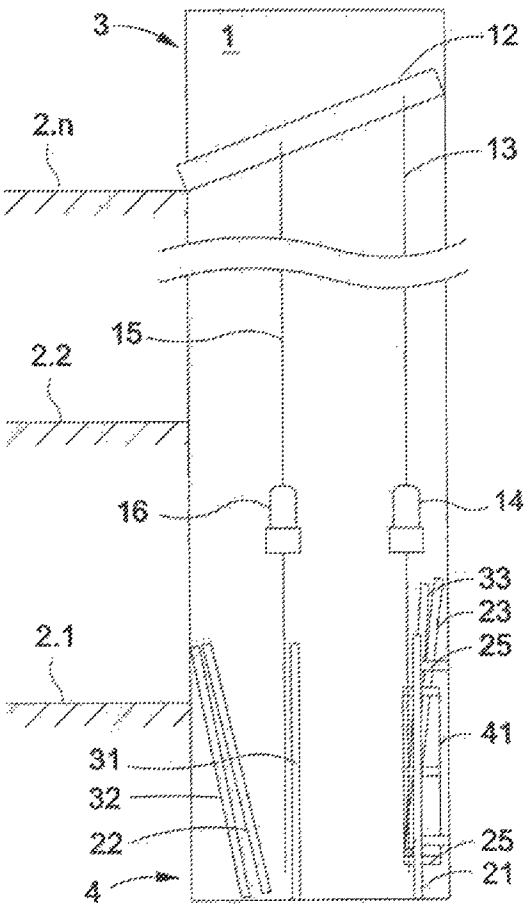
FIG. 3 shows the elevator shaft of FIG. 2 with a counterweight frame mounted on the first set of counterweight guide rails and a still further set of counterweight and car guide rails, which are loaded into the counterweight frame.

In yet a further step according to FIG. 3 a counterweight frame 41 is mounted on the first set of counterweight guide rails 21. The counterweight frame 41 shall serve during installation of the elevator as a material shuttle by which elevator components are moved to the mounting region in the shaft 1 along the already mounted counterweight guide rails. For that purpose the counterweight frame 41 is connected with the drive 14, for example by way of a cable or a chain. However, initially the counterweight frame 41 is loaded in a lower loading position with yet a further set of counterweight and car guide rails 23, 33.

Figure 4:
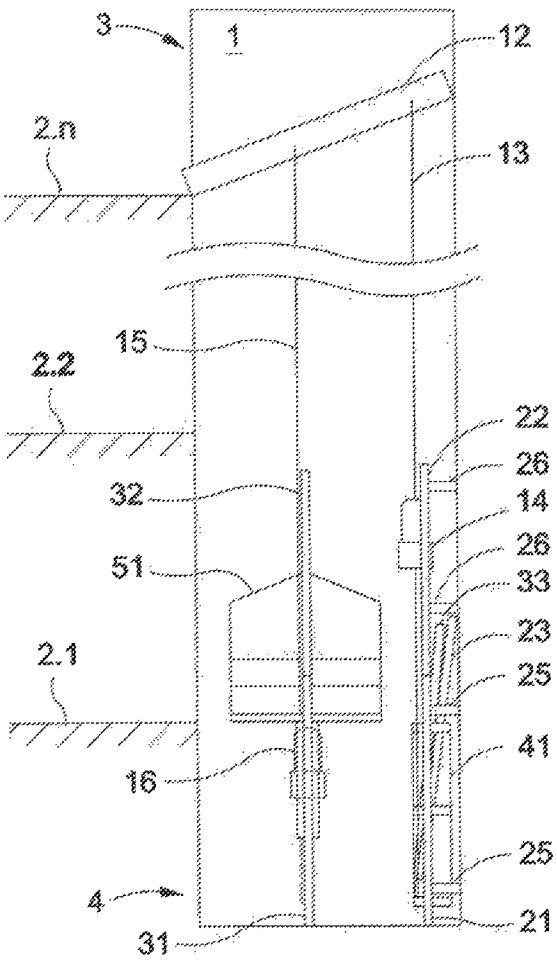
FIG. 4 shows the elevator shaft of FIG. 3 with an installation platform mounted on the first set of car guide rails.

FIG. 4 shows a further step in which an installation platform 51 is mounted on the first set of car guide rails 31. The installation platform 51 serves, during installation of the elevator, as a work platform, which is movable along the already mounted car guide rails and from which an engineer mounts elevator components in the region of the shaft. For that purpose the installation platform 51 is, as illustrated in FIG. 4, connected on its lower side with the drive 16. This connection can be produced, for example, simply and reliably by way of screw connections.

After mounting of the installation platform the further set of counterweight and guide rails 22, 32 is already mounted from a platform, in vertical alignment with and above the first set of guide rails 21, 31, each at a respective side wall of the shaft 1. In the case of this further set of guide rails 22, 32 the respective guide rails 22, 32 are also fastened to the side walls by means of brackets 26. This further set of guide rails 22, 32 is preferably lifted into the respective mounting position by means of the drive 14.

From FIG. 4 it is also apparent why two further sets of guide rails 22, 32, 23, 33 were already previously provided at the lower region of the shaft 1. In the lowermost work position of the installation platform, guide rails—which usually have a length of approximately 5 meters—can be readily introduced into the shaft 1 by way of the shaft opening of the lowermost floor 2.1.

Figure 5:
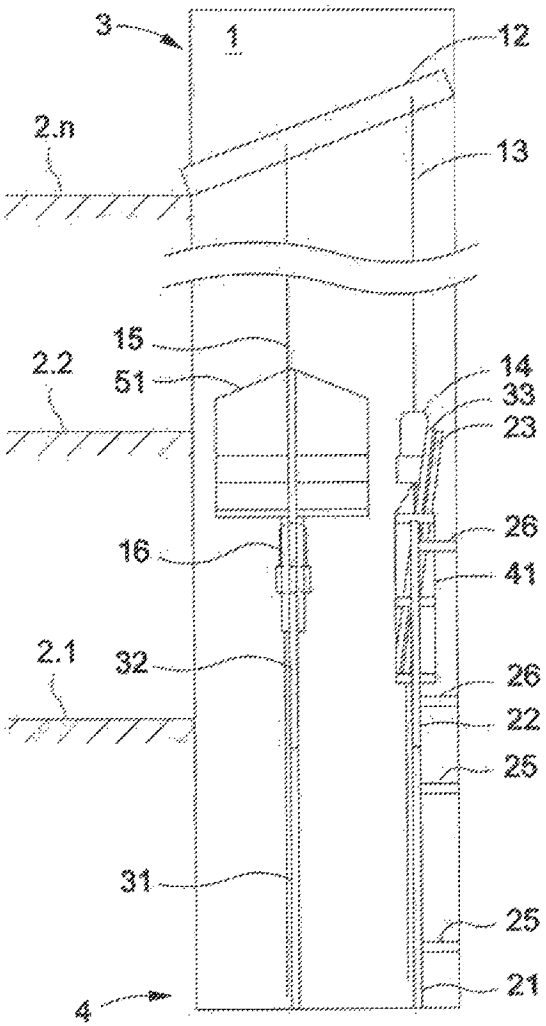
FIG. 5 shows the elevator shaft of FIG. 4 with the counterweight frame in an upper unloading position and the installation platform in an upper work position.

In a further step according to FIG. 5 the counterweight frame 41 is moved by means of the drive 14 from the lower loading position to an upper unloading position at the end of the already mounted counterweight guide rails 21, 22. On reaching the unloading position the counterweight frame 41 is fastened to the counterweight guide rails 22. For example, the counterweight frame 41 can be fastened to a crossbeam previously mounted in the end region of the counterweight guide rails. This makes it possible to separate the counterweight frame 41 from the drive 14. Advantageously, the drive 14 can be used for unloading the guide rails 23, 33 as well as for lifting the guide rails 23, 33 into a mounting position.

Correspondingly, the installation platform 51 is moved by means of the drive 16 into a second work position in the end region of the car guide rails 31, 32. In this second work position an engineer can, for example, mount the still further set of guide rails 23, 33 in vertical alignment with the already mounted guide rails 21, 31, 22, 32 on the respective shaft walls of the shaft 1.

It is apparent from FIG. 5 that in the second, upper work position of the installation platform 51 further guide rails can be brought into the shaft 1 in simple manner from the lowermost floor 2.1 and can be provided in the lower region 4 for later loading of the now unloaded counterweight frame 41.

Figure 6:
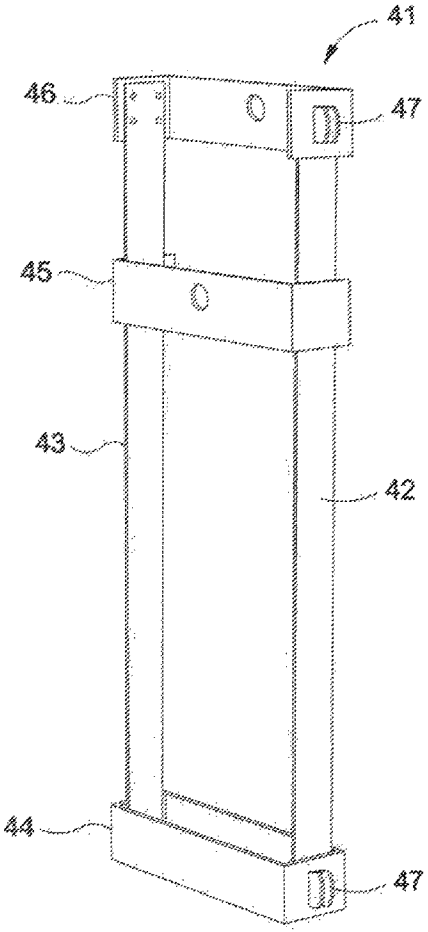
FIG. 6 shows a detail view of the counterweight frame.

FIG. 6 shows an embodiment of the counterweight frame 41. The counterweight frame comprises, according to this embodiment, two lateral girders 42, 43 which each connect an upper crossbeam 46 and a lower crossbeam 44. The lower crossbeam 44 is in that case so designed that it comprises a base plate on which an elevator component can be securely deposited and side walls preventing slipping of an elevator component off the base plate. The upper crossbeam 46 is in turn here provided with an eye in order simply and reliably connect the counterweight frame 41 with the hoist 13, 14. In addition, the upper crossbeam 46 ensures that an elevator component cannot tip laterally rearwardly.

A middle crossbeam 45 is so fastened to the lateral girders 42, 43 that it is easily removable at the time of loading so as to enable simple loading of the counterweight frame 41 and that after the loading it can be easily coupled again to the lateral girders 42, 43 so as to prevent an elevator component from laterally tipping forwards.

Finally, the counterweight frame 41 has guide elements 47 which are here designed as sliding guide shoes.

Figure 7:
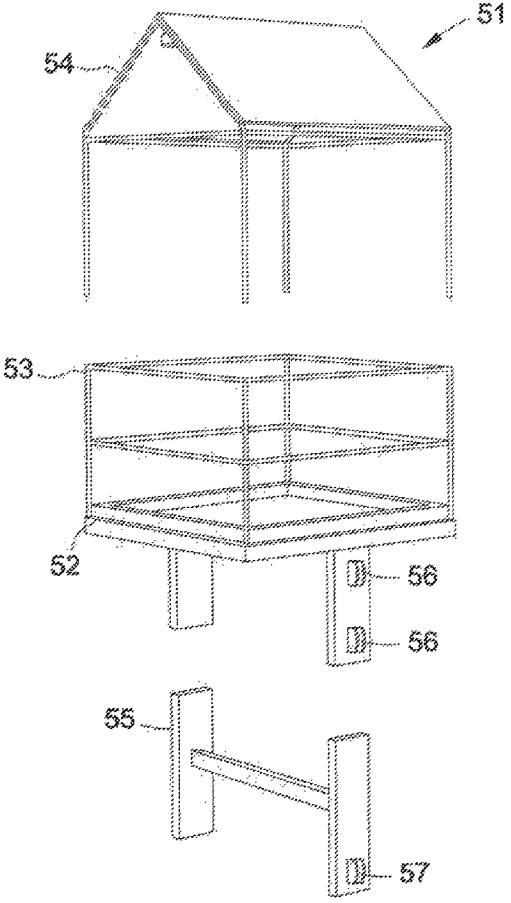
FIG. 7 shows a detail view of the installation platform.

An embodiment of the installation platform 51 is illustrated in FIG. 7. The installation platform 51 in that case comprises three sub-modules, namely a base platform 52 with a balustrade 53, which bounds the standing area of the base platform 52, a guide extension 55 and a roof construction 54. The guide extension 55 can be mounted on the base platform 52 and conducts guidance forces into a lower, more stable region of the car guide rails 31, 32. This makes it possible to move the installation platform 51 to a highest possible work position. The guidance of the installation platform 51 at the car guide rails 31, 32 is ensured by the guide elements 56, 57. The first-mentioned guide elements 56 are arranged on the base platform 52 and the last-mentioned guide elements 57 on the guide extension 55. The guide elements 56, 57 shown here are designed as sliding guide shoes. Finally, the roof construction 54 offers protection to engineers from objects falling down.

The installation method is not to be confined to the illustrated embodiment.

Rather, for example, the counterweight frame 41 can also be used as a material shuttle in co-operation with installation platforms fixedly installed in the shaft. In that case, an installation platform can be provided on each floor 2.1, 2.2, **2.*n* and can be respectively accessed by a shaft entrance. Elevator components such as, for example, the counterweight and car guide rails 23, 33 are movable by the counterweight frame 41 to an installation platform provided for later mounting of the elevator components. It is to be noted that the installation platforms have a spacing from a shaft wall sufficient for movement past of the counterweight frame 41**. The edge region of the installation platform is preferably to be provided with a balustrade at this spacing giving free space. It is in that way ensured that the engineer working on a respective installation platform cannot fall into the free shaft space.

Obviously, not only the counterweight and car guide rails 23, 33, but all elevator components intended for mounting in the shaft space, such as shaft doors or parts thereof, traction means, drives, electronic systems, safety equipment, sensor systems, etc., are movable by the counterweight frame 41. The counterweight frame 41 is preferably loaded with an elevator component in a loading position in the lower area 4 of the shaft 1 and moved by means of the hoist to an unloading position. Ultimately, these elevator components are mounted in an intended mounting position in the shaft 1.

Finally, the arrangement of the hoist can also be designed differently from the illustrated embodiment. Thus, for example, the drive 14 can be designed as a drum drive arranged in stationary location in the upper area 3 of the shaft 1. In that case, the drive winds up the support means on the drum or unwinds the support means from the drum depending on the respectively desired travel direction of the counterweight frame 41. Alternatively thereto the drive can also be designed as a traction drive which is arranged in stationary position in the upper area and transmits traction to the support means by way of a drive pulley or the like. In that case, the counterweight frame 41 can be suspended in any conceivable suspension ratio at the support means. Depending on the respective rated load and physical conditions the expert can use a hoist, which is designed for his or her specific needs, in order to move the counterweight frame 41.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An installation method for an elevator in an elevator shaft comprising the steps of:

providing a counterweight frame movable along counterweight guide rails in the shaft;

providing an installation platform movable along car guide rails in the shaft;

loading the counterweight frame with at least one elevator component to be installed in the shaft; and moving the counterweight frame along the counterweight guide rails relative to and independently of the installation platform.

2. The installation method according to claim 1 comprising the further steps of:

suspending a hoist, including a support device and a drive, in an upper area of the shaft in a travel region of an elevator car;

mounting a first set of the counterweight guide rails at a wall of the shaft bounding the travel region;

mounting the counterweight frame to be guided at the first set of counterweight guide rails;

suspending the counterweight frame at the hoist;

loading the counterweight frame with a second set of counterweight guide rails being the at least one elevator component;

moving the counterweight frame by the hoist into an unloading position in the shaft;

unloading the second set of counterweight guide rails from the counterweight frame; and mounting the second set of counterweight guide rails at the wall of the shaft bounding the travel region.

3. The installation method according to claim 2 comprising the further step of fixing the counterweight frame in an end region of the first set of counterweight guide rails after reaching the unloading position.

4. The installation method according to claim 3 comprising the further steps of:

separating the hoist from the counterweight frame fixed at the first set of counterweight guide rails in the unloading position; and lifting the second set of counterweight guide rails by the hoist into a vicinity of a mounting position in the shaft.

5. The installation method according to claim 2 comprising the further step of providing a third set of counterweight guide rails in a lower area of the shaft for later mounting in the shaft.

6. The installation method according to claim 2 comprising the further step of mounting a first set of car guide rails in the shaft.

7. The installation method according to claim 6 comprising the further step of providing a second set of car guide rails in a lower area of the shaft for later mounting in the shaft.

8. The installation method according to claim 7 comprising the further step of loading the counterweight frame with a third set of car guide rails for later mounting in the shaft.

9. The installation method according to claim 8 comprising the further steps of:

separating the hoist from the counterweight frame fixed at the an upper end of the second set of counterweight guide rails in the unloading position; and lifting the third set of car guide rails into a vicinity of a mounting position in the shaft.

10. The installation method according to claim 6 comprising the further steps of:

suspending another hoist, including another support device and another drive, in the upper area of the shaft in the travel region of an elevator car;

mounting the installation platform guided at the first set of car guide rails;

connecting the another hoist with the installation platform; and moving the installation platform by the another hoist into a work position in the shaft.

11. The installation method according to claim 2 comprising the further steps of:

automatically moving the counterweight frame by the hoist into an upper end position or a lower end position along the counterweight guide rails;

sensing the counterweight frame upon reaching the upper end position or the lower end position; and switching off the hoist in response to the sensing.

* * * * *